US008566985B2

(12) United States Patent
Kim

(10) Patent No.: US 8,566,985 B2
(45) Date of Patent: Oct. 29, 2013

(54) ORTHOPEDIC PILLOW FOR SOUND SLEEP

(75) Inventor: Hee Su Kim, Cheongan-si (KR)

(73) Assignees: T & I Co., Ltd., Hanam-si, Gyeonggi-do (KR); Hee Su Kim, Cheongan-si, Chungcheongnam-do (KR)

( * ) Notice: Subject to any disclaimer, the term of this patent is extended or adjusted under 35 U.S.C. 154(b) by 0 days.

(21) Appl. No.: 13/577,142

(22) PCT Filed: Jan. 25, 2011

(86) PCT No.: PCT/KR2011/000503
§ 371 (c)(1),
(2), (4) Date: Oct. 15, 2012

(87) PCT Pub. No.: WO2011/096663
PCT Pub. Date: Aug. 11, 2011

(65) Prior Publication Data

US 2013/0047339 A1 Feb. 28, 2013

(30) Foreign Application Priority Data

Feb. 5, 2010 (KR) ..... 20-2010-0001296 U

(51) Int. Cl.
*A47G 9/10* (2006.01)

(52) U.S. Cl.
USPC ..... 5/636; 5/637

(58) Field of Classification Search
USPC ..... 5/636, 637
See application file for complete search history.

(56) References Cited

U.S. PATENT DOCUMENTS

| | | | | |
|---|---|---|---|---|
| 2,940,088 | A * | 6/1960 | Boos | 5/636 |
| 4,218,792 | A * | 8/1980 | Kogan | 5/636 |
| 4,259,757 | A | 4/1981 | Watson | |
| 4,788,728 | A * | 12/1988 | Lake | 5/636 |
| 4,850,067 | A * | 7/1989 | Latorre | 5/636 |
| 5,727,267 | A * | 3/1998 | Keilhauer | 5/636 |
| 5,926,880 | A * | 7/1999 | Sramek | 5/636 |
| D474,364 | S | 5/2003 | Arcieri | |
| 6,622,325 | B1 * | 9/2003 | Garza | 5/636 |
| 7,082,633 | B1 * | 8/2006 | Maarbjerg | 5/636 |
| 8,161,588 | B1 * | 4/2012 | Anson | 5/636 |

FOREIGN PATENT DOCUMENTS

| | | | |
|---|---|---|---|
| JP | 11-512305 | A | 10/1999 |
| JP | 2005-046553 | A | 2/2005 |
| JP | 2007-514451 | A | 6/2007 |

* cited by examiner

*Primary Examiner* — Michael Trettel
(74) *Attorney, Agent, or Firm* — Nath, Goldberg & Meyer; Jerald L. Meyer

(57) ABSTRACT

An orthopedic pillow for deep-sleep, preferably including: a pillow body to be horizontally put on a floor; a cervical vertebrae supporter having a transverse groove at a front center of the pillow body to slantly support the occipital bone and protruding upward to accommodate cervical vertebrae; an occipital base and upper cervical vertebrae supporter having a round-shape, longitudinal linear protruding groove placed at an inner end of the cervical vertebrae supporter transverse to the pillow body to support a user's upper cervical vertebrae; a back head-resting portion having a concave depression on a middle surface of a width and length structure of the pillow body in the occipital base and upper cervical vertebrae supporter; and a side head-resting portion having accommodating grooves symmetrically depressed from the back head-resting portion longitudinally from the pillow body to support a user's side head including the ear when a user lies on their side.

7 Claims, 2 Drawing Sheets

ORTHOPEDIC PILLOW FOR SOUND SLEEP

This is a National Phase Application filed under 35 U.S.C. 371 as a national stage of PCT/KR2011/000503, filed Jan. 25, 2011, and claims priority benefit from Korean Application No. 20-2010-0001296, filed Feb. 5, 2010, the content of which is hereby incorporated by reference in its entirety.

TECHNICAL FIELD

The present invention relate to a functional orthopedic pillow for sound sleep, and more particularly, to a pillow used for orthopedic relaxation of the occipital bone, the lower occipital, the upper cervical vertebrae, the myofascia around the back of the neck, the duramater for protecting the central nervous system, and a deep muscle by providing soft stimulation to these parts, while inducing sound sleep.

BACKGROUND ART

When a user sleeps on the pillow, the neck and head of the user are comfortably supported by and rested on a pillow. Conventionally, various pillows are available according to materials and functionalities. For example, a hard pillow, a soft pillow, a pillow filled with functional materials such as medicinal herbs, and the like are used.

Because humans sleep for ⅓ of their life, comfortable sleep is very important. The most important thing for comfortable sleep is the pillow. It is generally known that most of shoulder discomfort, snoring, headache, insomnia, cervical disc problem, a forward head posture, etc. are caused by misuse of a pillow or by selecting an inappropriate pillow.

A conventional pillow is too hard, soft, high or low so that the head and the neck can freely move on the pillow instead of being comfortably placed thereon, causing a shoulder line to be crooked.

Also, the human body has a forward curved structure in a portion where the head and the upper cervical vertebrae are joined and has the center of mass biased forward more than the cervical vertebrae, so that the muscle of the occipital and the lower occipital is easily tensed.

Further, the stress of life, poor posture, various injuries, etc. cause this portion to be more severely tensed than other portions, and block occipital nerves, vertebral arteries, etc., thereby providing pressure on the lower occipital.

Then, many nerves passing through the jugular foramen are continuously pressed, and thus the muscle controlled thereby is tensed, so that an autonomous nervous system for maintaining the homeostasis undergoes a functional disorder, and in severe cases, the endocranium surrounding the encephalon is also tensed, causing constitutional symptom.

Thus, treatment for relaxing the tensed muscle and soft tissue of the occipital and the lower occipital is very important.

Conventionally, such tension on the occipital and the lower occipital has been inconveniently and manually relaxed through inconvenient medical treatment by a practitioner such as a manual therapist, a physical therapist, etc.

Examples of the medical treatment include cranial base release, CV4, and the like in cranosacral therapy (CST).

However, such treatment requires a practitioner to lift up a patient's head by his/her fingers until tension exerted on the occipital and the lower occipital is relaxed, this kind of treatment requires considerable physical exertion and long time, even though the treatment is very good for health, and thus it is difficult to apply this kind of treatment to many patients.

To solve such a problem, a pillow-shaped device is suggested to relieve tension exerted on the occipital and the lower occipital when a patent lies on the back using the device as a pillow.

However, such a device is used only for taking a short rest and is difficult to use during sleep. That is, this type of device cannot provide comfort when used for a long period of time and does not promote circulation of a cerebrospinal fluid by effectively and softly relaxing the cranial base, muscle of the lower occipital including the upper cervical vertebrae, and the occipital duramater.

Therefore, there is a need for a functional orthopedic pillow for a sound sleep, which can assist in circulation of a cerebrospinal fluid by effectively and softly relaxing the cranial base, muscle of the lower occipital including the upper cervical vertebrae, and the occipital duramater.

DISCLOSURE

Technical Problem

The present invention has been conceived to solve such a problem in the art, and an aspect of the present invention is to provide a pillow, which can stably hold user's head and neck in a balanced way while a user reclines the head on the pillow, and can prevent various diseases by circulating cerebrospinal fluid through a blood vessel and nervous tissue of the body including the encephalon and the spinal cord.

Another aspect of the present invention is to provide an ergonomic pillow, which naturally surrounds and softly presses the occipital when a user lies in a supine position, and prevents a user's head from being bent back when a user lies on their side.

A further aspect of the present invention is to provide a pillow for sleep, which induces sound sleep by providing comfort when a user's head is moved during sleep since a portion for supporting the head and neck is curved and matches with a moving path of the head.

Technical Solution

One aspect of the present invention provides an orthopedic pillow for sound sleep, including: a pillow body 100 to be horizontally put on a floor; a cervical vertebrae supporter 110 having a groove formed in a transverse direction at a front center of the pillow body 100 to slantly support the cervical vertebrae and protruding upward to accommodate the cervical vertebrae; an occipital base and upper cervical vertebrae supporter 120 having a linear protruding groove of a round shape formed in a longitudinal direction, the occipital base and upper cervical vertebrae supporter 120 being placed at an inner end of the cervical vertebrae supporter 110 in the transverse direction of the pillow body 100 to support a user's upper cervical vertebrae; a back head resting portion 140 depressed to have a concave curvature on a middle surface of a width and length structure of the pillow body 100 in the occipital base and upper cervical vertebrae supporter 120; and a side head resting portion 160 having accommodating grooves symmetrically depressed from the back head resting portion 140 in the longitudinal direction of the pillow body 100 to support a user's side head including their ear when a user lies on their side.

The back head resting portion 140 may include a back head holding portion 150 for pressing and holding the head in the transverse direction of the pillow body 100.

The back head holding portion 150 may include two protrusions symmetrical with respect to the transverse direction of the pillow body 100 to form a groove at the center thereof for securing a space where a user's head is supported.

The two protrusions may be arranged to have a narrower rear gap therebetween than a front gap therebetween in the transverse direction of the pillow body 100 or to have a narrower front gap therebetween than a rear gap therebetween, or may be horizontally arranged such that a front gap therebetween is the same as a rear gap therebetween.

Each of the two protrusions may be curved at the center thereof in the transverse direction of the pillow body 100 to allow the user's head to be easily placed thereon, and inwardly inclined to hold and press the head placed thereon.

The cervical vertebrae supporter 110 may be depressed to form a cervical vertebrae processus spinosus resting groove at the center thereof to facilitate a correct posture of a user's cervical vertebrae processus spinosus.

Each of the two protrusions may be inclined downwards in a concave shape from a front portion thereof toward a rear portion thereof over a distance from the cervical vertebrae supporter 110 to the back head holding portion 150 such that a user's head can be extended to easily secure a user's respiratory track.

The cervical vertebrae supporter 110 and the back head holding portion 150 may be rapidly inclined downwards in a concave shape when connecting from an upward protruding shape of the cervical vertebrae supporter 110 to a front surface of the back head holding portion 150 such that traction can be naturally induced by the weight of the head resting thereon while supporting an upper cervical vertebrae.

Advantageous Effects

According to the present invention, it is possible to easily provide a pillow at anytime and anywhere with functionality of effects based on finger-pressure treatment for the occipital and the lower occipital in manual treatment of cranosacral therapy (CST).

According to the present invention, the pillow may stably hold user's head and neck in a balanced way while a user reclines the head on the pillow, and may prevent various diseases by circulating cerebrospinal fluid through a blood vessel and nervous tissue of the body including the encephalon and the spinal cord when the pillow is used.

According to the present invention, it is possible to provide an ergonomic pillow, which naturally surrounds and softly presses the occipital when a user lies in a supine position, and prevents a user's head from being bent back when a user lies on their side.

According to the present invention, it is possible to provide a pillow for sleep, which induces sound sleep by providing comfort when a user's head is moved during sleep since a portion for supporting the head and neck is curved and matches with a moving path of the head.

<Description of Reference Numerals>

| | |
|---|---|
| 100: pillow body | 110: cervical vertebrae supporter |
| 115: cervical vertebrae processus spinosus resting groove | |
| 120: occipital base and upper cervical vertebrae supporter | |
| 130: rest inner wall | 140: back head resting portion |
| 150: back head holding portion | 160: side head resting portion |

BEST MODE

Figure 1:
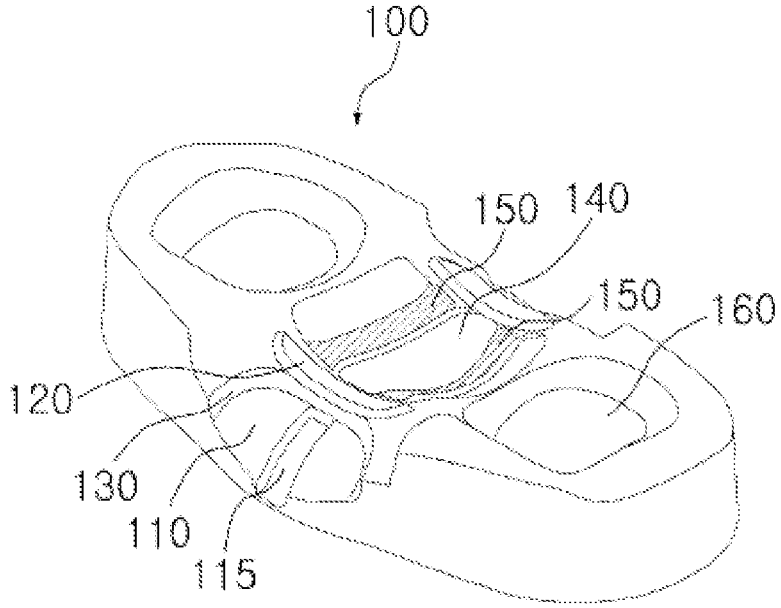
FIG. 1 is a perspective view of a pillow according to a first embodiment of the present invention.
Figure 2:
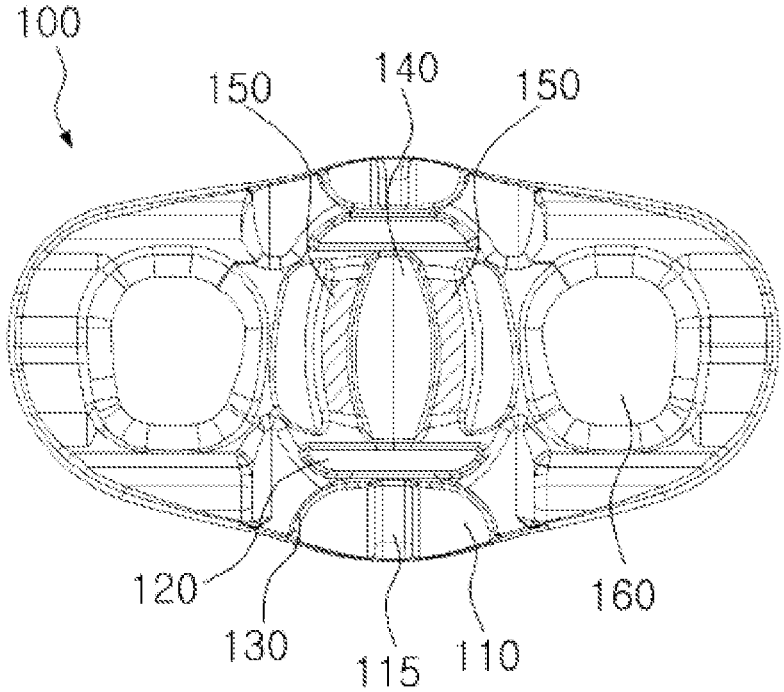
FIG. 2 is a plan view of the pillow according to the first embodiment of the present invention.
Figure 3:
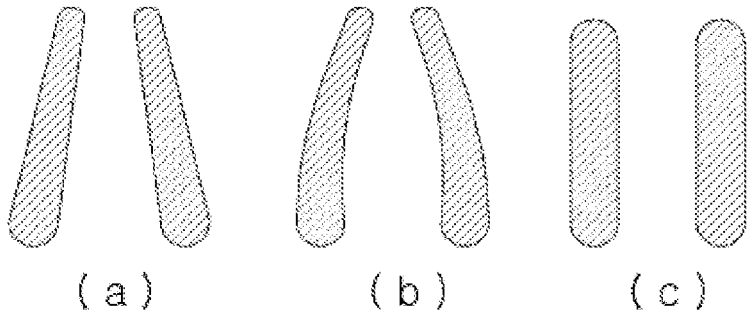
FIG. 3 shows one example of a back head holding portion in the pillow according to the first embodiment of the present invention.
Figure 4:
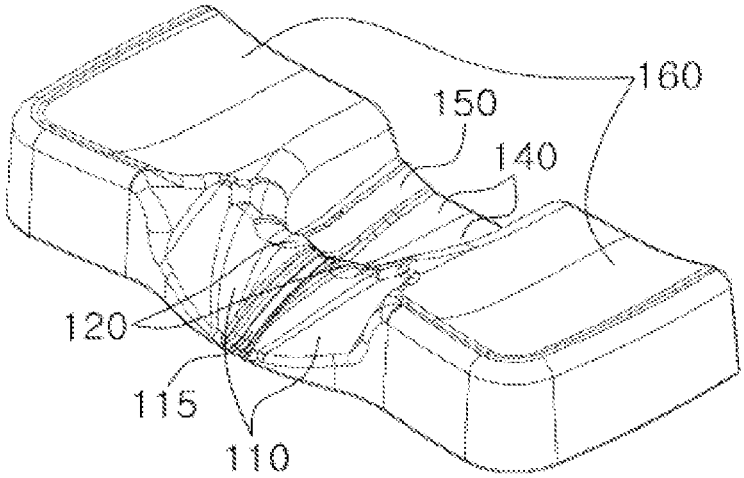
FIG. 4 is a perspective view of a pillow according to a second embodiment of the present invention.
Figure 5:
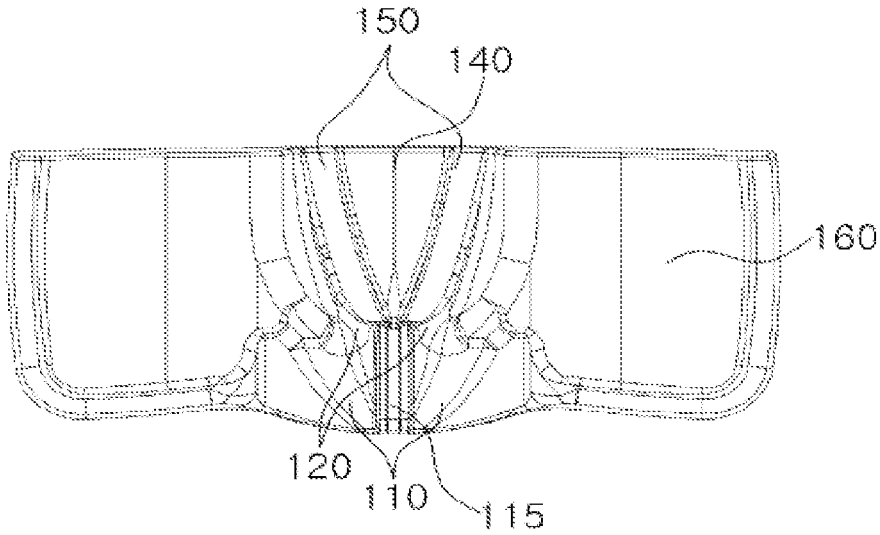
FIG. 5 is a plan view of the pillow according to the second embodiment of the present invention.

FIG. 1 is a perspective view of a pillow according to a first embodiment of the present invention, FIG. 2 is a plan view of the pillow according to the first embodiment of the present invention, FIG. 3 shows one example of a back head holding portion in the pillow according to the first embodiment of the present invention, FIG. 4 is a perspective view of a pillow according to a second embodiment of the present invention, and FIG. 5 is a plan view of the pillow according to the second embodiment of the present invention.

As shown in FIGS. 1 to 5, a whole frame of the pillow generally has a rectangular shape in a top view and has curvatures based on difference in height corresponding to portions when viewed from the side.

The whole configuration of the pillow will be described hereinafter. A pillow body 100 has a flat bottom to be horizontally placed on a floor, and includes cervical vertebrae processus spinosus resting grooves 115 formed at a front center of the pillow body 100 in a transverse direction thereof such that the occipital bone can be slantly supported thereon, and cervical vertebrae supporters 110 depressed to accommodate the occipital bone.

To this end, each of the cervical vertebrae supporters 110 is internally provided with a rest inner wall 130 acting as an inner wall.

Thus, the cervical vertebrae supporters 110 generally have a concavely rounded shape.

In this case, the concavely rounded shape of the cervical vertebrae processus spinosus resting groove 115 is bilaterally symmetrical.

At this time, a top surface of the cervical vertebrae supporter 110 may be inclined upward from a front end to a rear end by taking the shape of the occipital bone into account, so that an occipital bone region can be more comfortably supported and rested on a uniform surface.

Referring to FIGS. 1 and 2, the cervical vertebrae supporters 110 are formed at front and rear central regions of the pillow body 100 in the transverse direction. In this case, the cervical vertebrae supporters 110 have the same shape, but may be different in size and depth of the cervical vertebrae processus spinosus resting groove 115.

Such configuration allows a user to use the pillow according to sex/age and head sizes.

Also, as shown in FIGS. 4 and 5, each of the cervical vertebrae supporters 110 is configured to become wider like an alphabet of 'V' as a contact area increases from the cervical vertebrae toward the head. Further, the cervical vertebrae supporter 110 becomes higher from the cervical vertebrae toward the head to make stable contact with a user from the cervical vertebrae to the head.

The cervical vertebrae processus spinosus resting groove 115 is formed at the center of the alphabet of 'V' and may vary in size and depth.

Further, the pillow body 100 is provided at an inward end of the cervical vertebrae supporter 110 in the transverse direction thereof with an occipital base and upper cervical vertebrae supporter 120, which has a linear protruding groove of a round shape formed in a longitudinal direction to support a user's neck.

At this time, each of the cervical vertebrae supporters 110 includes inclined protrusions inclined downward in a forward direction and separated from each other in left and right directions, and forms the cervical vertebrae processus spinosus resting groove 115 between the inclined protrusions.

The occipital base and upper cervical vertebrae supporter 120 is configured to support a user's neck which connects the occipital bone and the back head, thereby inducing the correct sleeping posture.

To this end, as shown in FIG. 1, the occipital base and upper cervical vertebrae supporter 120 may be shaped like a flat straight protrusion having a predetermined height in order to easily support a user's neck.

Further, as shown in FIGS. 4 and 5, the occipital base and upper cervical vertebrae supporter 120 may protrude in a predetermined shape at opposite sides thereof in order to support only a portion which connects the occipital bone and the back head.

Alternatively, the height and shape of the protrusions may be varied within a technical range for supporting the neck.

In the occipital base and upper cervical vertebrae supporter 120, a back head resting portion 140 depressed to have a concave curvature on a middle surface of a width and length structure of the pillow body 100 is provided. This shape of the pillow is an important factor. Next, the back head resting portion 140 according to one embodiment of the invention will be described in more detail.

The back head resting portion 140 is depressed to form a groove in which a user's head will rest. In this case, the back head resting portion 140 includes a back head holding portion 150 for pressing and holding the head in the transverse direction of the pillow body 100.

Referring to FIGS. 1 and 2, the back head resting portion 140 having such a depressed shape is configured to have an approximately circular longitudinal section, without being limited thereto. Alternatively, the back head resting portion 140 may have other shapes capable of defining a space in which the protuberance occipitalis externa will be accommodated.

In this case, the back head holding portion 150 may include two protrusions in the transverse direction of the pillow body 100 so as to form a groove therebetween for defining a space in which a user's head is supported.

At this time, the two protrusions may be arranged to have a narrower rear gap therebetween than a front gap therebetween in the transverse direction of the pillow body 100 or to have a narrower front gap therebetween than a rear gap therebetween, or may be horizontally arranged such that a front gap therebetween is the same as a rear gap therebetween.

Also, each of the two protrusions may be curved at the center thereof in the transverse direction of the pillow body 100 to allow the user's head to be easily placed thereon, and inwardly inclined to hold and press the head placed thereon.

In this case, an edge is rounded to make a user comfortable while supporting a user's head.

Further, each of the two protrusions is inclined downwards in a concave shape from a front portion thereof toward a rear portion thereof over a distance from the cervical vertebrae supporter 110 to the back head holding portion 150 such that a user's head can be extended to easily secure a user's respiratory track.

As shown in FIGS. 4 and 5, the cervical vertebrae supporter 110 and the back head holding portion 150 are rapidly inclined downwards in a concave shape when connecting from an upward protruding shape of the cervical vertebrae supporter 110 to a front surface of the back head holding portion 150 such that traction can be naturally induced by the weight of the head resting thereon while supporting an upper cervical vertebrae.

Further, a side head resting portion 160 is configured to have accommodating grooves symmetrically depressed from the back head resting portion 140 in the longitudinal direction of the pillow body 100 and support a user's side head including their ear when a user lies on their side.

In this case, the accommodating groove of the side head resting portion 160 has an inner wall to form a depressed curvature rounded in a depth direction and thus make a user comfortable when they lie on their side.

Further, as shown in FIGS. 4 and 5, the side head resting portion 160 is formed to have a flat shape such that the side head can be stably rest thereon and be in contact therewith.

In the pillow having the structure and shape as described above, the pillow body and the other components may be made of a material that can support the lower occipital and the upper cervical vertebrae while allowing a slight change in shape when pressed by the weight of a user's head, and be rapidly restored to an original state after user's sleep.

To this end, the pillow according to the present invention may be made of urethane, latex, memory foam, sponge, a soft pipe, or any other elastic functional material synthesized from these materials.

As described above, when a user reclines the head on the pillow according to the present invention, the cervical vertebrae supporter 110 naturally presses the occipital bone and naturally surrounds the occipital, and the back head resting portion 140 softly presses and holds the back head so as to provide user comfort and permit sound sleep. Further, when a user lies on their side, the opposite ends of the back head resting portion 140 are spaced apart and depressed to hold a user's side head comfortably, thereby providing the correct sleeping posture and user comfort to induce sound sleep.

Further, the cervical vertebrae supporter 110, the occipital base and upper cervical vertebrae supporter 120, and the back head resting portion 140 have curvatures that match with a moving path of a user's head when a user's head is moved during sleep, thereby providing comfort. When a user sleeps in a supine position, a user's body is maintained, but a user's head is freely movable leftward and rightward. Thus, the pillow is configured to naturally press the head placed thereon along the moving line.

According to the embodiments, the orthopedic pillow for sleep presses a nape line of the neck on a lower occipital supporting portion and stimulates parasympathetic nerves innervated in the occipital base and the upper cervical vertebrae, so that sympathetic nerves tensed by stress can remain normal, thereby keeping a balance of an autonomic nervous system and thus recovering biorhythm and energy.

Further, when a user lies using the pillow, the occipital base and upper cervical vertebrae supporter 120 is used to support the back of the neck, so that not only a user can feel comfortable but also muscle around the cervical vertebrae in the back of the neck can be stimulated and relaxed, thereby relieving neck tension while preventing and curing a cervical disc and a forward head posture.

At this time, the occipital between the portions supported by the cervical vertebrae supporter 110 and the occipital base and upper cervical vertebrae supporter 120 is supported in a way of perching thereon, so that the left and right sides of the cervical vertebrae around the back of the neck can be comfortably supported and pressed.

As such, according to the present invention, the back head resting portion 140 has a depressed curvature on which a user's back head rests comfortably, and the back head holding portion 150 supports and presses the head to permit sound sleep. Further, the occipital bone, the lower occipital, the upper cervical vertebrae and the myofascia around the back of the neck, and deep muscle can receive acupressure when using the pillow according to the present invention.

Although some embodiments have been described with reference to the accompanying drawings, it should be understood by those skilled in the art that these embodiments are given by way of illustration only, and that various modifications, variations, and alterations can be made without departing from the spirit and scope of the invention. Therefore, the scope of the invention should be limited only by the accompanying claims and equivalents thereof.

The invention claimed is:

1. An orthopedic pillow for sound sleep, comprising:

a pillow body 100 placed horizontally on a floor;

a cervical vertebrae supporter 110 having a groove formed in a transverse direction at a front center of the pillow body to obliquely support the cervical vertebrae of a user and protruding upward to accommodate the cervical vertebrae of the user;

an occipital base and upper cervical vertebrae supporter 120 having a linear protruding groove of a round shape formed in a longitudinal direction, the occipital base and upper cervical vertebrae supporter 120 being placed at an inner end of the cervical vertebrae supporter 110 in the transverse direction of the pillow body 100 to support the user's upper cervical vertebrae;

a back-of-the-head resting portion 140 depressed to have a concave curvature on a middle surface of a width and length structure of the pillow body 100 in the occipital base and upper cervical vertebrae supporter 120; and a side-of-the-head resting portion 160 having accommodating grooves symmetrically depressed from the back-of-the-head resting portion 140 in the longitudinal direction of the pillow body 100 to support a side of the user's head including their ear when a user lies on their side, wherein the back-of-the-head resting portion 140 comprises a back-of-the-head holding portion 150 for pressing and holding the head in the transverse direction of the pillow body 100, and wherein the back-of-the-head holding portion 150 comprises two protrusions symmetrical with respect to the transverse direction of the pillow body 100 to form a groove at the center thereof for securing a space where a user's head is supported.

2. The orthopedic pillow according to claim 1, wherein the two protrusions are arranged to have a narrower rear gap therebetween than a front gap therebetween in the transverse direction of the pillow body 100 or to have a narrower front gap therebetween than a rear gap therebetween, or are horizontally arranged such that a front gap therebetween is the same as a rear gap therebetween.

3. The orthopedic pillow according to claim 1, wherein each of the two protrusions is curved at the center thereof in the transverse direction of the pillow body 100 to allow the user's head to be easily placed thereon, and inwardly inclined to hold and press the head placed thereon.

4. The orthopedic pillow according to claim 1, wherein the cervical vertebrae supporter 110 is be depressed to form a cervical vertebrae processus spinosus resting groove at the center thereof to facilitate a correct posture of a user's cervical vertebrae processus spinosus.

5. The orthopedic pillow according to claim 1, wherein each of the two protrusions is inclined downwards in a concave shape from a front portion thereof toward a rear portion thereof over a distance from the cervical vertebrae supporter 110 to the back-of-the-head holding portion 150 such that a user's head can be extended to easily secure a user's respiratory track.

6. The orthopedic pillow according to claim 1, wherein the cervical vertebrae supporter 110 and the back-of-the-head holding portion 150 are rapidly inclined downwards in a concave shape when connecting from an upward protruding shape of the cervical vertebrae supporter 110 to a front surface of the back-of-the-head holding portion 150 such that traction can be naturally induced by the weight of the head resting thereon while supporting an upper cervical vertebrae of the user.

7. The orthopedic pillow according to claim 1, wherein the cervical vertebrae supporter 110 and the back-of-the-head holding portion 150 are rapidly inclined downwards in a concave shape when connecting from an upward protruding shape of the cervical vertebrae supporter 110 to a front surface of the back-of-the-head holding portion 150 such that traction can be naturally induced by the weight of the head resting thereon while supporting an upper cervical vertebrae of the user.

* * * * *